United States Patent [19]

Yancey

[11] 4,034,876

[45] July 12, 1977

[54] BOOM CONSTRUCTION AND METHOD FOR MAKING SAME

[75] Inventor: John W. Yancey, Aurora, Ill.

[73] Assignee: Caterpillar Tractor Co., Peoria, Ill.

[21] Appl. No.: 570,985

[22] Filed: Apr. 23, 1975

Related U.S. Application Data

[62] Division of Ser. No. 472,965, May 28, 1974, Pat. No. 3,902,295.

[51] Int. Cl.[2] ..... E02F 3/38

[52] U.S. Cl. ..... 214/152; 212/144; 214/145 R

[58] Field of Search ..... 214/145 R, 138 R, 152; 212/144; 52/730

[56] References Cited

U.S. PATENT DOCUMENTS

| | | | |
|---|---|---|---|
| 1,593,261 | 7/1926 | Holmes | 212/414 |
| 2,066,600 | 1/1937 | Wilson | 214/145 R |
| 2,610,754 | 9/1952 | Inskeep | 52/730 |
| 3,237,353 | 3/1966 | Gilmore | 212/144 |
| 3,581,919 | 6/1971 | Karlsson | 214/138 R |
| 3,856,161 | 12/1974 | Baron | 214/138 R |

*Primary Examiner*—Albert J. Makay
*Assistant Examiner*—Ross Weaver
*Attorney, Agent, or Firm*—Phillips, Moore, Weissenberger, Lempio & Majestic

[57] ABSTRACT

An excavator boom has attachment means formed on opposite ends thereof for attachment to a vehicle and to a work implement. The boom comprises a pair of continuous and uninterrupted upper and lower plates and a pair of side plates, all secured together by four continuous welds to form a box section throughout the length of the boom. The boom is generally V-shaped and has a third attachment means formed at the apex thereof. During fabrication of the boom, the various plates and attachment means are positioned in suitably arranged fixtures and are tack welded together. The boom is then placed on each of its sides for final welding purposes.

7 Claims, 8 Drawing Figures

BOOM CONSTRUCTION AND METHOD FOR MAKING SAME

This is a division of Ser. No. 472,965, filed May 28, 1974, now U.S. Pat. No. 3,902,295.

BACKGROUND of THE INVENTION

Implement carrying booms for hydraulic excavators and the like are normally fabricated from a plurality of steel plates secured together by a multiplicity of transverse and longitudinal welds. The plates are normally roll formed to provide a back-up ridge for the longitudinal welds (see FIG. 8 of applicant's drawings) which gives rise to various stress problems discussed in applicant's copending U.S. application Ser. No. 348,926, filed on Apr. 9, 1973 for "stress-relieved Weldment for Box Sections". Stress concentrations are particularly occasioned at a mid-portion of the boom whereat cast members are secured thereto to provide attachment means for one end of a hydraulic cylinder which is further attached to a vehicle for boom raising and lowering purposes.

SUMMARY OF THIS INVENTION

An object of this invention is to provide a boom construction which exhibits a high degree of structural integrity and an economical method for expeditiously making the same. The boom comprises attachment means formed on opposite ends thereof, a pair of continuous and uninterrupted upper and lower plates and side plates secured to the upper and lower plates by four continuous weld means extending substantially the full length of the boom. The boom is fabricated by positioning the various plates and attachment means in suitably arranged gigs and fixtures and by initially tack welding them together. The boom is then laid on each of its sides for the final welding operation.

BRIEF DESCRIPTION OF THE DRAWINGS

Other objects of this invention will become apparent from the following description and accompanying drawings wherein.

DETAILED DESCRIPTION

Figure 1:
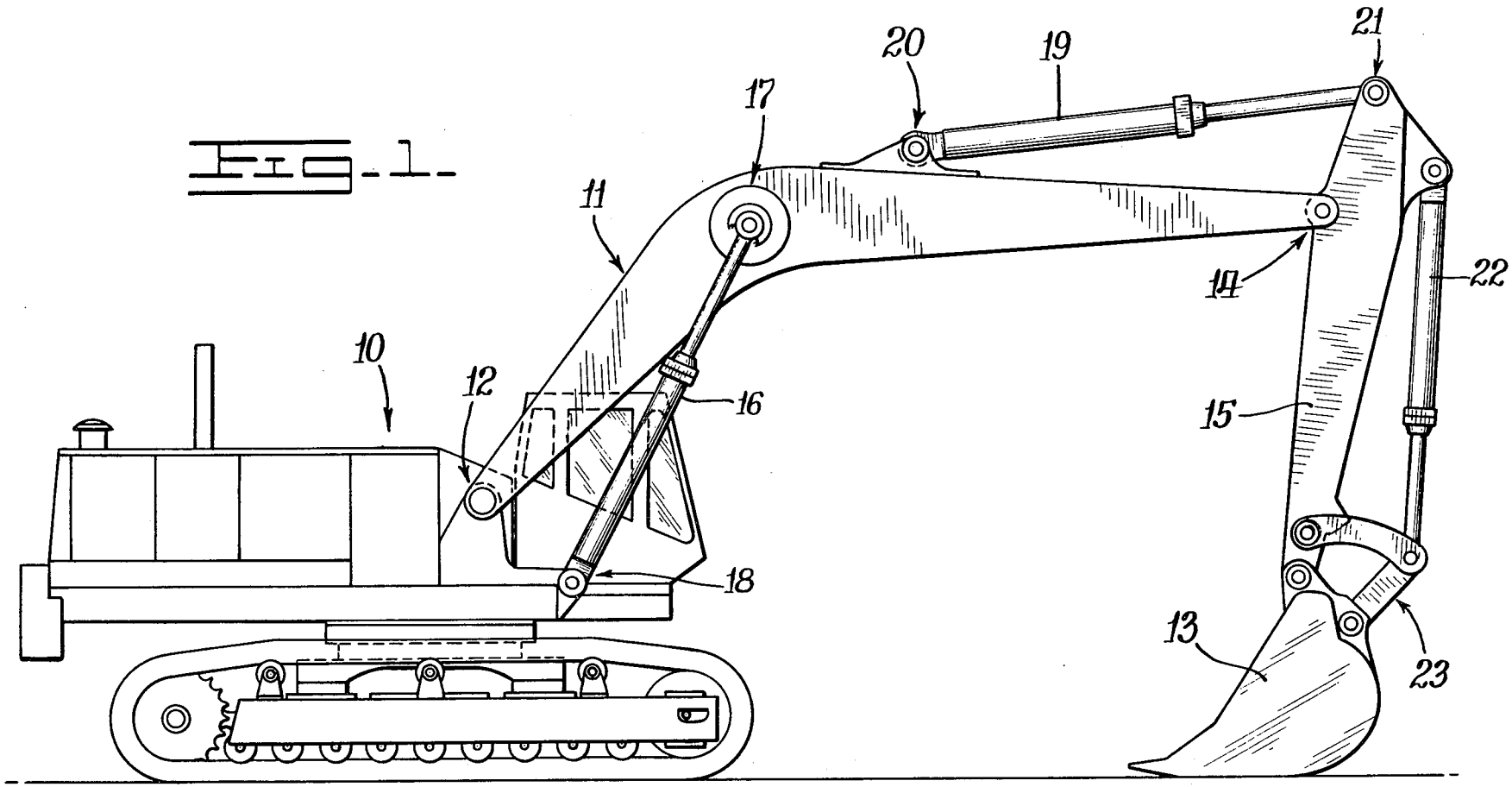
FIG. 1 is a side elevational view of a hydraulic excavator employing a boom of this invention thereon.

FIG. 1 illustrates a hydraulic excavator 10 having a first end of a boom 11 of this invention pivotally mounted thereon by a first pivot means 12. The second end of the boom is attached to a work implement, such as a bucket 13, by a second pivot means 14 and intermediate stick 15. The boom is generally V-shaped and has a pair of first double-acting hydraulic cylinders 16 (one shown) each attached to an apex thereof by a third pivot means 17.

The head end of the cylinders are each pivotally attached on the vehicle by a fourth pivot means 18 to facilitate raising or lowering of the boom under control of the operator. A second double-acting hydraulic cylinder 19 has its head end mounted on an upper side of the boom by a fifth pivot means 20 and its rod end is attached to the upper end of stick 15 by a sixth pivot means 21. A third double-acting hydraulic cylinder 22 is pivotally interconnected between an upper end of stick 15 and bucket 13, through suitable linkage means 23, to selectively pivot the bucket on the stick.

Figure 2:
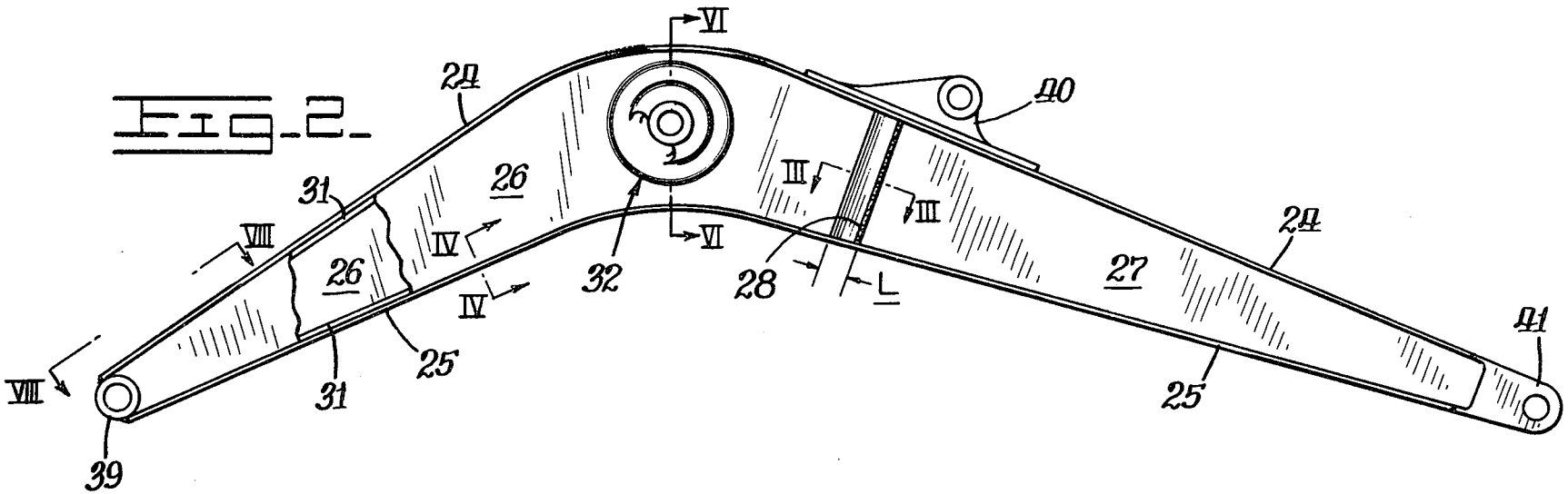
FIG. 2 is an enlarged, side elevational view of the boom.

Referring to FIG. 2, boom 11 comprises a pair of continuous and uninterrupted upper and lower plates 24 and 25, respectively, and a pair of side plates 26 secured thereto. The structurally integrated plates form a box section substantially throughout the full length of the boom. Each side plates 26 comprises a pair of plates 26 and 27 secured together at a transverse weld 28 (FIG. 3).

The weld is backed-up throughout its length by a flat member 29 disposed interiorly of the boom. The boom's structural integrity is not adversely affected by such a weld. In particular, the major stresses imposed on the boom during operation thereof occur adjacent to its apex, at attachment means 17 (FIG. 1).

Figure 3:
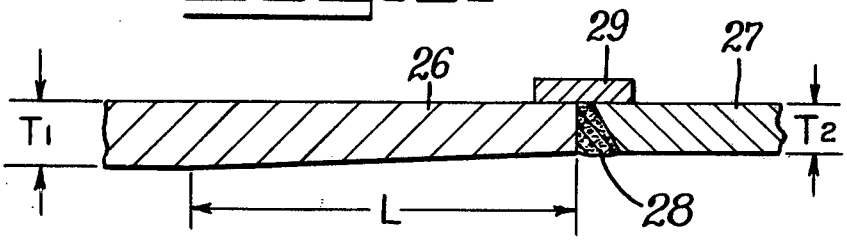
FIG. 3 is an enlarged sectional view taken in the direction of arrows III—III in FIG. 2.

As further shown in FIG. 3, each plate 26 may have a thickness $T_1$ (e.g., 1 in.) which is greater than the thickness $T_2$ (e.g., three-fourth in.) of each plate 27. The forward end of each plate 26 is preferably machined to form a taper throughout a forward portion L of its length to match the thickness of a respective, co-planar plate 27. Such a construction substantially reduces the overall weight of the boom without adversely affecting its bending strength.

Figure 4:
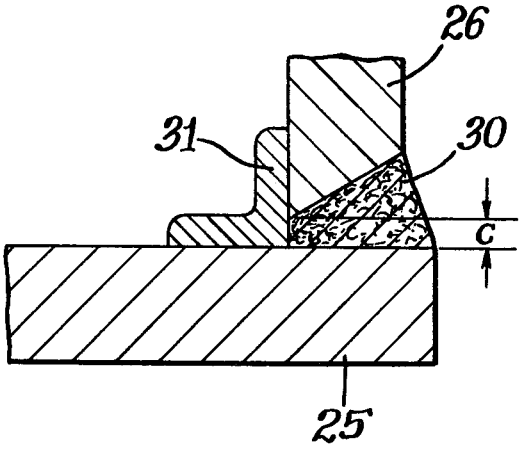
FIG. 4 is an enlarged sectional view taken in the direction of arrows IV—IV in FIG. 2.
Figure 5:
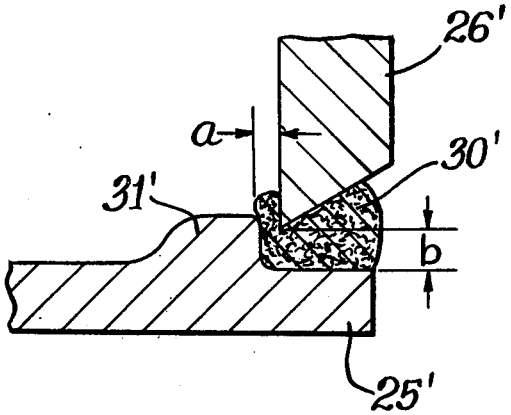
FIG. 5 is a view similar to FIG. 4 but illustrating a prior art weldment.

Referring to FIG. 4 the upper, lower and side plates are secured together by four continuous weld means 30, each securing a lateral side of one of the upper and lower plates to a respective one of the side plates. As shown, each weld means 30 has a generally V-shaped cross section terminating at an apex thereof at an L-shaped angle bar 31 which functions as a back-up means for the weld. Such a stress relieved weldment is fully disclosed in applicant's above referenced U.S. application Ser. No. 348,926. In particular, FIG. 5 illustrates a prior art weldment wherein a pair of plates 25' and 26' are secured together by a weld 30' which terminates at its apex at a rolled section 31' formed on plate ≅'.

Since the rolled section is formed integrally with the plate, it cannot be selectively sized or positioned to accommodate manufacturing and assembly tolerances *a* and *b*. As a result, weld "blow-through" may occur whereby a poor weldment is formed to adversely affect the overall structural integrity of the boom. In contrast thereto, angle bar 31 (FIG. 4) can be suitably sized and positioned to provide a zero clearance between the angle bar and side plate 26 and a precisely controlled clearance C at the apex or root of weld 30 to assure the formation of structurally sound weldments.

Figure 6:
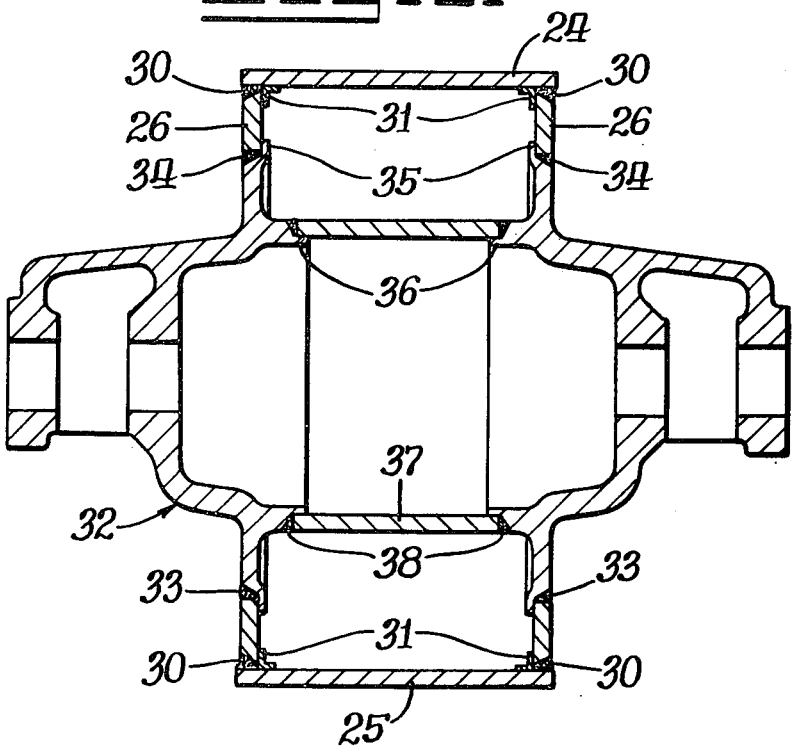
FIG. 6 is an enlarged cross sectional view taken in the direction of arrows VI—VI in FIG. 2.
Figure 7:
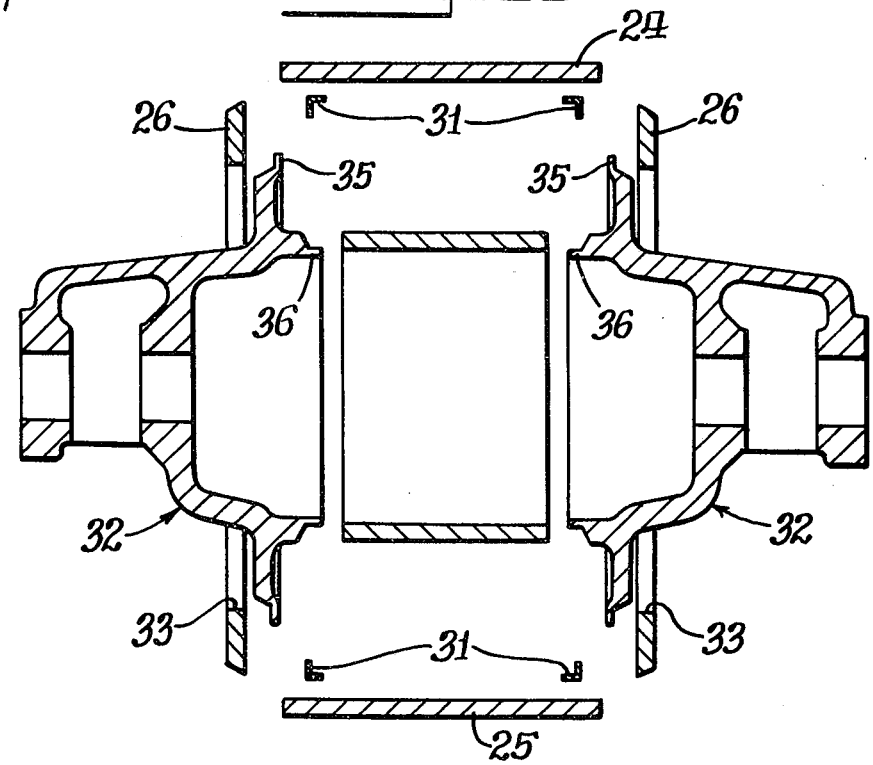
FIG. 7 is a view similar to FIG. 3 but showing attachment structure exploded with the welds removed therefrom.

Referring to FIGS. 1, 6 and 7, pivot means 17 comprises an attachment means including a pair of bell castings 32 each extending through an annular opening 33 formed through a respective side plate 26 and secured thereto by an annular weld 34. An annular first flange 35 is formed on each bell casting to extend radially outwardly therefrom to abut inner surface portions of plate 26 to precisely position the bell casting thereon and to also provide a weld back-up means thereat for weld 34. An annular second flange 36 extends axially inwardly from each bell casting to underlie a respective end of an intermediate cylindrical connecting member 37. A pair of annular welds 38 secure the opposite ends of the connecting member to the bell castings.

Figure 8:
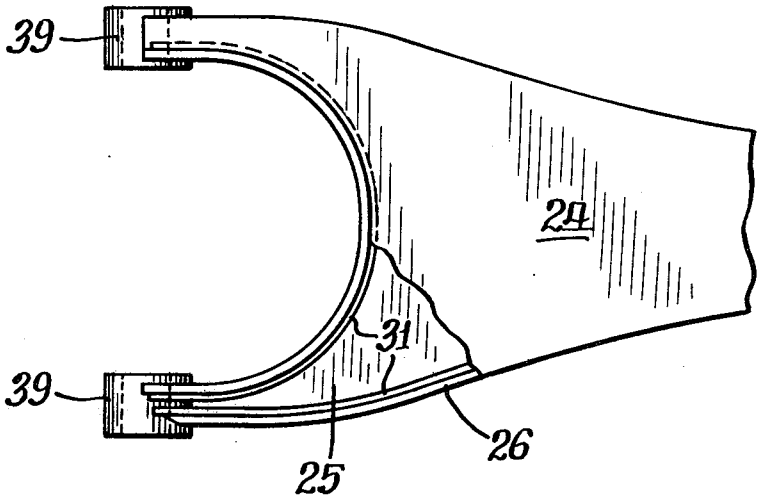
FIG. 8 is an enlarged top plan view of one end of the boom, taken in the direction of arrows VIII—VIII in FIG. 2.

Referring to FIGS. 1 and 8, first pivot means 12 comprises an attachment means or yoke at the first end of the boom having a pair of bearing bushings 39 secured thereon for pivotally mounting the boom on the frame of vehicle 10. Referring to FIGS. 1 and 2, second pivot means 14 comprises an attachment means or casting 40 welded on the second or forward end of the boom for pivotal attachment to stick 15. As further shown, fifth pivot means 20 comprises an attachment means or casting 41 secured on upper plate 24 for pivotally attaching the head end of cylinder 19 thereon.

METHOD OF FABRICATION

Boom 11 is fabricated by first flame cutting and shaping upper, lower and side plates 24 –26. Openings 33 (FIG. 7) are formed through the side plates and castings 32 and member 37, presecured together by welds 38, are suitably mounted therein. The vertical legs of preshaped angle bars 31 are then tack welded to the side plates in a suitable fixture whereby each leg projects slightly beyond a lateral end of a side plate to precisely set clearance C (FIG. 4) for subsequent formation of the weld grooves for welds 30.

Lower plate 25 is then mounted in a suitable fixture, in its FIG. 2 position. The side plates, having castings 32 and member 37 tack welded thereto, are then accurately positioned on the bottom plate 25 and tack welded thereto. Top plate 24 is then positioned on the side plates and tack welded thereto along with castings 32 and 41 and bushings 39.

The tack welded sub-assembly is then turned on a first side thereof to complete the exposed major welds, including a weld 34 and two of the four continuous welds 30 securing the upper, lower and side plates together. The boom is then turned over onto its second, opposite side and a similar welding operation is effected thereon to complete the major welds. The boom is then mounted on excavator 10 (FIG. 1) and attached to the various cylinders and stick 15.

I claim:

1. A method for making a boom comprising the steps of, first cutting and shaping a pair of substantially identical upper and lower plates and a pair of substantially identical side plates, forming openings in the side plates for receiving pivot bell castings therein, joining a pair of pivot bell castings, having annular axial flange means and radial flange means which include a portion arranged to abut the inner surface portions of the side plates, by joining said annular axial flange means to respective ends of a cylindrical connecting member, then welding the side plates to the radial flange means of said bell casting assemblies, then tack welding one leg of an angle bar to the edges of the side plates so that each angle bar projects above said edges a predetermined amount for defining the width of subsequent lateral welds joining said side plates to upper and lower plates abutted thereagainst and for providing a backup member for such welds, then positioning the assembly so formed on a lower plate and tack welding the assembly to the lower plate with the other legs of the angle bars abutting the lower plate, thereafter positioning an upper plate on the top lateral edges of the side plates, also in abutting relationship with the other legs of the angle bars, and tack welding the upper plate to the assembly, then turning the tack welded assembly on a first side plate and completing an annular weld of one bell casting to the other side plate and securing the upper and lower plates to said other side plate, thereafter turning the assembly on to said other side plate and completing an annular weld of the other bell casting to the first side plate and securing the upper and lower plates to the first side plate.

2. The method of claim 1 wherein each of said first and second securing steps comprises securing an apex of a respective weld means to a respective angle bar.

3. The method of claim 1 wherein each of said side plates are pre-fabricated by securing a pair of co-planar first and second plates together by a weld disposed transversely relative to said side plates.

4. The method of claim 3 further comprising the steps of pre-forming said first plate with a wall thickness greater than the wall thickness of said second plate and forming an end portion of the length of said first plate adjacent to said second plate with a wall thickness substantially matching the wall thickness of said second plate.

5. The method of claim 1 further comprising the steps of securing an attachment means on each end of said boom.

6. The method of claim 1 further comprising the steps of pre-forming each of said plates into a V-shape to comprise a boom which is generally V-shaped when viewed in side elevation and securing an attachment means at an apex of said boom.

7. The method of claim 5 further comprising pivotally mounting said boom on a frame of a vehicle at one of said attachment means and attaching said boom to a work implement at the other one of said attachment means.

* * * * *